United States Patent [19]

Connew

[11] Patent Number: 4,998,391

[45] Date of Patent: Mar. 12, 1991

[54] STRUCTURAL ELEMENT

[75] Inventor: Raymond A. Connew, Colchester, England

[73] Assignee: Shinebuild Limited, Suffolk, England

[21] Appl. No.: 399,472

[22] PCT Filed: Feb. 22, 1988

[86] PCT No.: PCT/GB88/00107

§ 371 Date: Oct. 11, 1989

§ 102(e) Date: Oct. 11, 1989

[87] PCT Pub. No.: WO88/06218

PCT Pub. Date: Aug. 25, 1988

[30] Foreign Application Priority Data

Feb. 23, 1987 [GB] United Kingdom ..... 8704111

[51] Int. Cl.[5] ..... E04F 15/00

[52] U.S. Cl. ..... 52/179; 52/181

[58] Field of Search ..... 52/177, 179, 181; 428/98, 917

[56] References Cited

U.S. PATENT DOCUMENTS 4,522,861 6/1985 Dunsworth .

4,625,266 11/1986 Winter ..... 52/188 X 4,858,404 8/1989 Schluter ..... 52/179

*Primary Examiner*—David A. Scherbel

*Assistant Examiner*—Creighton Smith

*Attorney, Agent, or Firm*—Watson, Cole, Grindle & Watson

[57] ABSTRACT

Device for mounting on the tread (1) of a step of a staircase which comprises a generally planar member adapted to be mounted upon or adjacent the leading edge of the horizontal portion (the tread) of a step of a staircase and extending rearwardly over part or all of the width of the step, which rearwardly extending portion of the member is provided with a strip (14) of photoluminescent material. The invention also provides a flooring grade sheet plastic containing a photoluminescent material suitable for use in the device of the invention.

5 Claims, 2 Drawing Sheets

STRUCTURAL ELEMENT

The present invention relates to a structural element, notably to a stair tread fitting having a photoluminescent element thereto, and to a material for use therein.

BACKGROUND TO THE INVENTION:

Stairs often present hazards to users, notably when they are poorly lit or not lit at all, for example when the lighting to a staircase well fails in whole or in part. It has therefore been proposed to apply a stripe of luminescent paint to the riser of each of the steps of the staircase, which strip will glow in the dark and give the user a guide as to the location of each step. However, such a method can not be applied where the steps are to be carpeted. Furthermore, the paint stripe can only be a temporary solution to the problem, since it is readily scuffed and removed by the soles of users feet or shoes during normal use of the staircase.

It has also been proposed to apply a stip of self-adhesive plastic tape to the stair riser. However, the edge of the strip is readily torn during use of the staircase leading to removal of the strip and a potential safety hazard.

The above problems with paints or adhesive tapes would be aggravated if they were applied to the horizontal tread of the step rather than to the vertical riser, since the abrasion and scuffing action of users shoes or feet is much larger. On the other hand, another problem with paint and tapes applied to the riser of the stair is that they are not readily visible to users of the stairs from above and they do not glow brightly for prolonged periods. We believe that this is due to the fact that they are mounted on the vertical face which is obscured to a person descending the staircase and is a face onto which only a small amount of direct light falls during normal illumination of the staircase.

It has been proposed to fix a strip of a flexible plastic edging strip incorporating a photoluminescent material across the step at the apex of its nose. The photoluminescent material was formed as a bead protruding from the edging strip so that it would be visible to users both ascending and descending the staircase. However, this position exposes the material to the maximum abrasion and wear during normal use of the staircase. Furthermore, it was found that the light emitted from the photoluminescent material rapidly became obscured. It is believed that this was because the material into which the photoluminescent material was incorporated was of a porous nature and that it readily picked up dirt which became firmly imbedded therein, thus reducing the effect of the photoluminescent material.

It has been found that the above problems can be reduced if the photoluminescent material is incorporated into a generally planar member having an abrasion resistant exposed face mounted upon the horizontal tread of the stair and having a metal or similar protective means along its leading edge.

By mounting the photoluminescent material in a substantially horizontal position, the present invention ensures that it will receive the maximum activation from any overhead lighting source and hence be capable of glowing for prolonged periods when the light source is removed. Furthermore, the glow is more readily seen by a user descending as well as ascending the staircase than where the photoluminescent material is located on the face of the riser as hitherto considered necessary. Also, it has been found that any obstruction on the staircase is more readily apparent to the user than when the photoluminescent material is mounted on the riser of the staircase. It has also been found that although the material is mounted upon that part of the stair exposed to severe abrasion and wear, the action of the users' shoes and feet is generally parallel to the exposed face so that they act to wipe the exposed face and thus reduce problems to the build-up and embedding of dirt in the exposed face. The presence of the protective leading edge not only reduces the risk of detachment of the photoluminescent material from the stair tread, but also serves to support part of the load of a users' shoes or feet and thus to reduce wear of the exposed face.

SUMMARY OF THE INVENTION:

Accordingly, the present invention provides a generally planar member adapted to be mounted upon or adjacent the leading edge of the tread of a step of a staircase and extending rearwardly over part or all of the width of the step, which rearwardly extending portion of the member is provided with a strip of photoluminescent material.

In a preferred embodiment, the invention provides a device for affixing to the horizontal portion (the tread) of a step of a staircase (the tread) which device comprises a generally planar horizontal elongated member adapted to be mounted adjacent the leading edge of the step and to extend rearwardly across at least part of the area of the tread of the step and having a wear-resistant exposed translucent upper face and incorporating a photoluminescent material, the leading edge of the member being provided with a protective member.

Preferably, the device comprises an elongated metal or other extrusion or moulding having an axial recess therein into which the photoluminescent material is incorporated, the photoluminescent material having a translucent abrasion resistant overlay providing the exposed upper face, the member having an upstanding leading edge along the recess which provides the protective member for the photoluminescent material. It is also preferred that at least initially the exposed face be proud of the upper surface of the protective member along its leading edge.

In a particularly preferred form of the device, the photoluminescent material is incoporated into a laminated plastic material, notably a flooring grade sheet plastic material, and a strip of that material is provided in the recess of the moulding or extrusion.

Flooring grade plastic sheet material containing a photoluminescent material is believed novel, and the invention therefore also provides a plastic material suitable for mounting upon an area to be walked upon by a user and in strip, sheet or other planar form, which material comprises a base layer having a reflective upper surface; an intermediate layer incorporating a photoluminescent material; and an upper translucent wear-resistant layer. Preferably, the base layer incorporates a white pigment; the intermediate layer incorporates a combination of a photoluminescent material and light reflective particles such as glass beads or chips; and the upper layer is translucent and is provided with a wear resistant upper surface. A particularly preferred upper layer comprises a vinylic polymer having a plasticiser content of from 25 to 45 parts by weight per 100 parts by weight of resin and the composite sheet has a Shore A hardness of from 80 to 95.

The invention further provides a step of a staircase having mounted adjacent the leading edge of the tread thereof and extending rearwardly thereof over at least part of the area of the tread a device of the invention.

The invention may be applied to a wide range of forms of staircase: for example to wooden, steel or concrete straight or curved fixed staircases in a building, to companionways in ships; and to portable structures such as ladders, loft ladders and step ladders. For convenience the term staircase is used herein to denote in general all such structures comprising a flat surface (the tread) upon which a user steps, which surfaces are arranged in ascending or descending sequence to enable the user to ascend or descend between different levels. The invention is of especial use on fixed staircases mounted in buildings which have a series of horizontally staggered treads linked to one another by upright risers located adjacent the front edge of an upper tread and adjacent the rear edge of a lower tread to form a conventional staircase. However, it will be appreciated that the risers may be omitted to give what is known as an open tread staircase.

DESCRIPTION OF THE DRAWINGS:

For convenience the invention will be described in terms of a fixed conventional staircase with treads and risers and to aid understanding of the invention it will be described with respect to the preferred form thereof shown in the accompanying drawings in which.

DETAILED DESCRIPTION OF THE PREFERRED EMBODIMENTS

Figure 1:
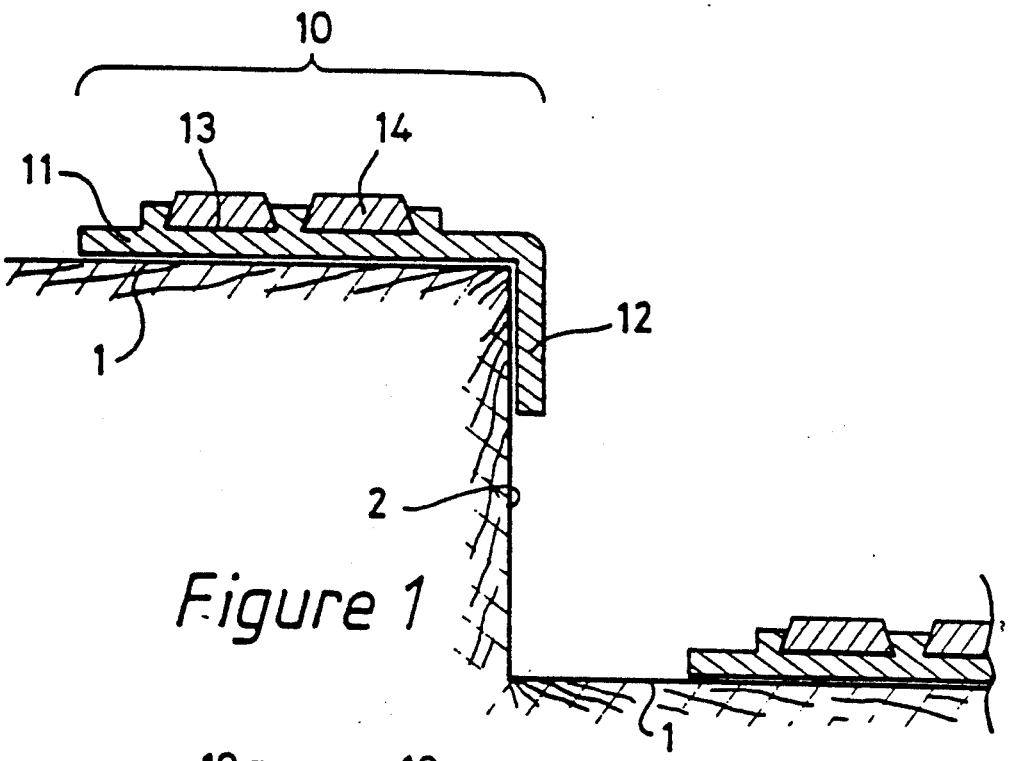
FIG. 1 is a vertical section through a step of a staircase carrying a member of the invention.

The staircase is formed from a staggered series of substantially horizontal treads 1 linked by substantially vertical risers 2. Typically the step will be constructed from wood as shown. However, other materials of construction may be used and the tread and riser need not be separate members, but can be formed as a single unit as when the staircase is cast in concrete or is made from welded steel or the like. As indicated above, the risers 2 may be omitted and the treads can be of slatted or mesh construction. However, it is preferred that the tread present a solid horizontal surface upon which the user treads.

Upon some or every step tread is mounted a device 10 of the invention incorporating a photoluminescent member. This can take the form of a simple strip of flooring grade plastic material incorporating the photoluminescent material and secured to the tread 1 in the desired position by adhesive, screws or the like. However, it is preferred to support the strip of material in a metal or other edge piece which not only protects the nose of the stair against wear, but also secures and protects the leading edge of the photoluminescent material. Such an edge piece typically comprises a steel, aluminium or rigid plastic extrusion 11 having one or more axial recesses, slots or grooves 13 into which the photoluminescent material 14 is located.

Figure 2:
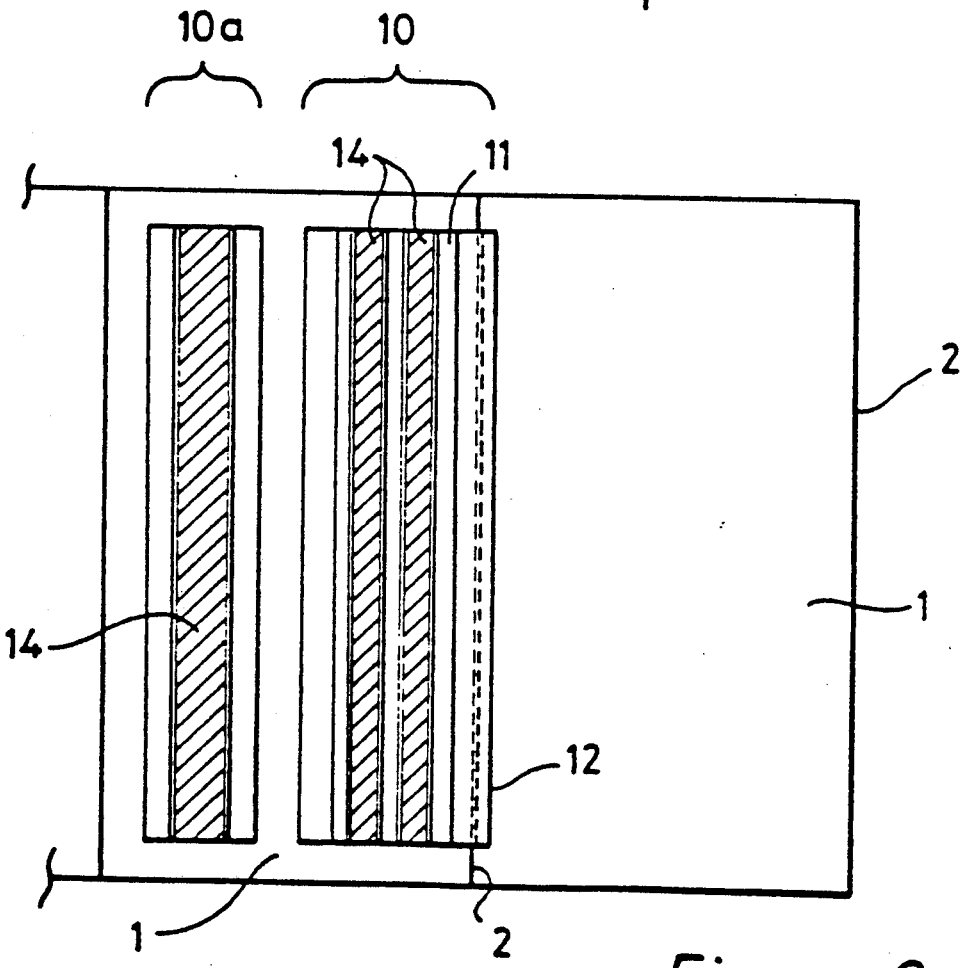
FIG. 2 is a plan view of the step of FIG. 1.

The extrusion 11 preferably extends over substantially all its length rearwardly at least part of the way over the face of the tread 1 as shown in FIG. 2. If desired, the tread can be provided with one device of the invention along its nose, which can carry two or more strips of photoluminescent material, with one or more further devices (10*a*, 10*b*) affixed upon the rearward area of the tread as shown in FIG. 2.

The extrusion 11 is a generally planar member affixed upon the upper surface of the tread. However, as shown in FIG. 1, it is preferred that the extrusion 11 have a dependent front skirt 12 which overlies the upper portion of the riser 2 of the step, or an upstanding rear edge which extends up at least part of the riser at the rear of the tread. The precise form and size of the extrusion 11 can be selected in known manner to suit the size and shape of the step it is to fit.

Figure 4:
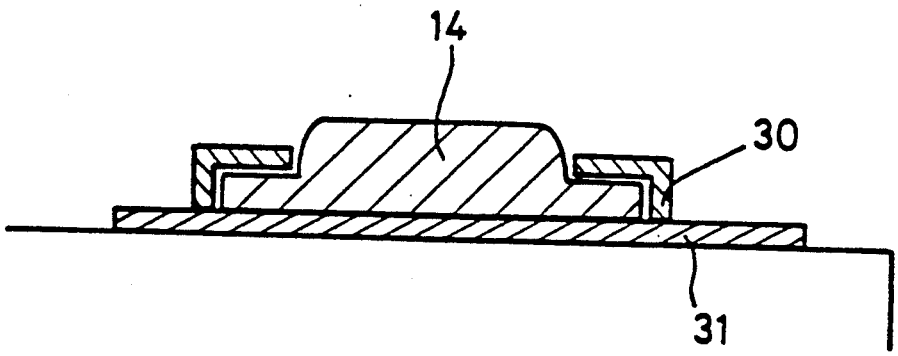
FIGS. 4 and 5 are views of alternative forms of the member of FIG. 1.

The extrusion 11 is provided with one or more grooves or recesses 13, preferably longitudinal, into which strips 14 of photoluminescent material are to be secured. The recesses 13 can be formed as the extrusion 11 is formed or can be formed subsequently, for example by clamping strip retaining bars 30 onto a base plate 31 to clamp the edges of the strips 14 in place, as shown in FIG. 4. The recesses 13 desirably take the form of rectangular cross-section channels in the upper face of the extrusion into which strips 14 of the photoluminescent material are a close fit. If desired the channels can have undercut edges to co-operate with a trapezoidal cross-section to strips 14. The channels extend axially of extrusion 11, preferably as unbroken recesses along the whole length of the extrusion so that the photoluminescent material lies across substantially the whole width of the stair tread as shown in FIG. 2. As shown in FIG. 2, there can be two or more strips of photoluminescent material along each extrusion 11.

As indicated above, the strips 14 of photoluminescent material are to be located inwardly of the leading edge of the extrusion so that the leading edge of the extrusion prtects the edge of strip 14 against the wear of users shoes and feet. We also prefer that the extrusion be mounted at or adjacent the nose of the step to give a user an indication of the position of the edge of the step. Thus, we prefer that the leading edge of extrusion 11 be located within 30 mms, preferably within 0 to 20 mms, of the edge of tread 1. Otherwise, the extrusion 11 and strip 14 can be located as desired. Where extrusion 11 has a dependent front skirt 12, it will be appreciated that this carries the leading edge of the extrusion over the leading edge of the step and this skirt or the upstand at the rear of the extrusion can carry one or more photoluminescent strips to indicate the position of the riser to the step to a user.

Within recess 13 is located a strip of photoluminescent material 14. Preferably, this strip is provided by a length of substantially non-porous plastic material incorporating a photoluminescent material, which strip is a close fit within recess 13. The strip 14 can be secured within the recess by any suitable method, for example by being a tight fit within an undercut lip to the recess as shown in FIG. 2 or by screws or other fixing means. It is particularly preferred to secure the strip in place by a suitable adhesive. Alternatively, the base of the recess can be coated with a suitable photoluminescent paint or the like.

Figure 5:
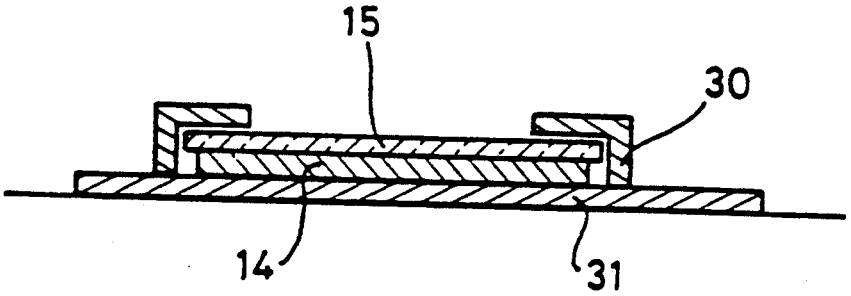

The photoluminescent material strip is protected against excessive abrasion and lifting by the extrusion 11. If desired, the recess 13 can be given a transparent cover 15 to protect the strip 14 and to secure it within the recess as shown in FIG. 5. However, it is preferred to form the strip 14 from a flooring grade plastic material incorporating a translucent non-porous upper layer so that the exposed upper face of strip 14 will resist wear by the feet of users. Where this is done, the upper face of strip 14 can be set so that it is flush with or stands slightly proud of the upper face of the extrusion 11 as shown in FIG. 1. By doing this, problems of loss of illumination from the photoluminescent strip due to dirt intrapment within the recess or on the face of strip 14 are reduced. In effect, the face of the strip 14 will be wiped by the users' feet as they tread on the step, thus preventing excessive build up of dirt on the face of the strip. Furthermore, where the surface of strip 14 is worn down to the level of the leading edge of extrusion 11, the extrusion will carry at least part of the weight of a user and will protect the strip 14 against rapid erosion during normal use of the staircase.

Alternatively, the material of one or more layers of the strip can be selected so as to allow the strip to be compressed slightly so that the majority of the load of the user is supported by the extrusion 11 and not by the strip 14. Thus, the lower layer of a laminated plastic strip 14 can be a foamed material.

The strip 14 can be formed from conventional ingredients using conventional plastics technology, except that the polymer composition forming all or part of the strip contains one or more photoluminescent active materials. Thus, the strip 14 can be formed by extruding a suitable thermoplastic polymer composition such as a translucent polyvinylic resin or the like and applying a coat of a photoluminescent paint or the like to the under surface thereof. However, it is particularly preferred that the strip 14 be in the form of a composite material having a flexible protective upper layer and a lower photoluminescent layer. Thus, the strip can be formed by co-extruding a clear PVC layer having a Shore A hardness of from 85 to 92 with a PVC layer containing photoluminescent material. Suitable PVC resins for present use are those containing from 30 to 40 parts by weights of plasticizer, e.g. a phthalate plasticizer, per 100 parts by weight of resin. It is especially preferred that there should also be a lower reflective layer to enhance the light emission from the strip.

Figure 3:
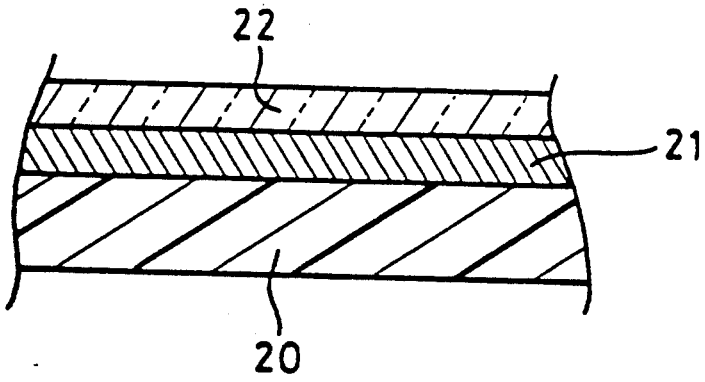
FIG. 3 is a vertical section through a flooring grade plastic material for use in the member of FIG. 1.

A suitable structure for the strip 14 is shown in FIG. 3 and comprises a base layer 20, a layer 21 containing the photoluminescent material and a translucent top layer 22. Such a material can be made from conventional flooring grade plastics materials and using conventional sheet plastics fabrication techniques. Thus, the base layer 20 can be a sheet of vinylic, polyurethane or polyethylene polymer or a blend or copolymer of such materials, for example with butadiene and/or styrene. The layer 20 can be a rigid polymer layer having a Shore hardness of substantially 100; or can be formed from an expanded polymer to allow the resultant strip 14 to have a measure of compressability. Typically, layer 20 will be from 1 to 5 ms thick and can be made up from a series of thinner layers if required.

As indicated above, layer 20 is to be reflective so that the maximum light from the intermediate layer 21 is directed upwardly. This can be achieved by forming a reflective layer 24 on the face of layer 20, e.g. by laying a metal foil upon layer 20 or by deposition a metallic film on layer 20. Alternatively, layer 20 need not be a polymer layer but could be in the form of a reflective metal foil or even the highly polished base to the recess 13. However, it is preferred to incorporate a white pigment such as titanium oxide pigment and/or reflective particles such as glass beads or chips into the polymer from which layer 20 is formed so that the layer is inherently reflective.

Layer 21 contains the photoluminescent material, preferably in conjunction with reflective particles such as glass beads or chips which enhance light emission from the layer. The photoluminescent material can be selected from a wide range of such materials. Thus, suitable materials for present use include radioactive gasses, e.g. tritium, encapsulated in a polymer bead such as a polycarbonate; or metal sulphides, notably calcium, stronium or zinc sulphides or mixtures thereof. If desired, the active ingredient can be applied as a coating to a solid carrier, such as a finely particulate metal, e.g. copper. Typically, the photoluminescent material will be present as a particulate or crystalline material dispersed in a thermoplastic polymer base. The amount of photoluminescent material is typically from 50 to 500 gs, preferably 100 to 400 gs, of active ingredient per square metre of exposed surface area through which light is to be emitted. If desired, the layer 21 can contain other ingredients, notably materials which fluoresce in daylight such as organic fluorescins. Suitable polymer sheets containing the photoluminescent materials are available commercially and may be used as such in the prduction of the strips 14. However, the layer 21 may also be formed in situ by applying a paste or solution of the required ingredients and a carrier polymer, or an oligomer or monomer precursor thereof, to layer 20 or to the base of recess 13 as indicated above, and causing the polymer for the layer 21 to be formed in situ by suitable polymerisation techniques as is known in the art.

The strip 14 has an upper layer 22 which is to be exposed to the feet of the user. This layer is translucent not only to allow the photoluminescent material to be activated by light falling on strip 14 but also to allow the glow from layer 21 to be visible in the dark. Preferably, layer 22 is transparent and substantially clear. Thus, layer 22 can be formed from a polyvinyl, polyurethane or other polymer using conventional techniques and additives to enhance the UV stability and other functions of the polymer layer. The layer 22 protects layer 21 against abrasion during use and therefore is formulated to floor grade requirements as is known in the art. Thus, the layer will typically be formed from a clear PVC resin having a Shore A hardness of from 80 to 97 to give it the desired flexibility for wear resistance.

The overall composite structure for strip 14 can be made by co-extrusion where only two layers are present or by laminating pre-formed polymer sheets using hot pressing or other conventional techniques to cause the layers to adhere to one another, optionally with adhesive interface layers. Thus, a PVC composite structure can be made by causing the various layers to fuse together under pressure and at elevated temperatures. In a particularly preferred method of manufacture, a clear PVC top layer having a shore hardness of 86 to 92, an intermediate layer containing photoluminescent zinc sulphide particles and a base layer of one or more plies of a rigid PVC having a Shore hardness of substantially 100 is fused together at 150° to 175° C. under a pressure of from 100 to 200 psi gauge.

The composite structure described above may omit one or more of the layers, e.g. the base reflective layer where a reflective foil is present or the base of the recess 13 is sufficiently highly polished to provide the necessary reflective effect.

The composite structure described above may contain other ingredients conventionally used in polymer mixes, for example antioxidants or dyes in the upper layer to provide a colour other than green to the light emitted from the strip 14; and may be subjected to further treatment as is known to enhance its properties. Thus, the composite structure can be given a surface coating of a silicone or other polmer to provide a non-slip surface thereto and/or to aid resistance to adherence of dirt to the exposed face of layer 22. The strips 14 are formed from the composite structure by cutting the overall sheet of material into the required strips using a mechanical knife or air blade or a heated wire cutter.

The strips 14 are secured into the recesses 13 using any suitable technique and will usually extend for the full length of the recess. However, it is within the scope of the present invention for the strips 14 to be comparatively short and to alternate with, for example, conventional anti-slip material also carried in recesses 13.

In use, the extrusion 11 is secured by any suitable means to the desired location on the treads 1 of a staircase. However, it will be appreciated that the composite flooring grade structure described above, can also be used elsewhere where a photoluminescent material is required in a location where it is to be subjected to abrasion. Thus, the composite structure can be formed into broad strips which are set into extrusions or similar settings to provide markers for mounting on or into the floor of a room. In the event of a power failure or other emergency when the light source fails, such markers can provide a path on the floor which occupants of the room can follow.

Thus, the invention also provides a method for marking areas to be trodden by a user or lines of travel to be followed by a user, notably foot paths on the floor of a structure, which comprises securing a device or a wear-resistant flooring grade composite structure of the invention to that area or adjacent that line of travel.

I claim:

1. A device comprising a generally planar member adapted to be mounted upon or adjacent the leading edge of the horizontal tread portion of a step of a staircase and extending rearwardly over part or all of the width of the step, which rearwardly-extending portion of the member is provided with at least one recess extending widthwise of the member and accommodating at least one light-emitting element, wherein the or each element comprises a strip of a flooring grade plastic sheet material which comprises a base layer having a reflective upper surface, an intermediate layer incorporating photoluminescent material and an upper translucent, wear-resistant layer, said upper layer of the or each element having an exposed upper face disposed above the remainder of the device.

2. A device as claimed in claim 1, wherein the base layer incorporates a white pigment and wherein the intermediate layer incorporates a combination of a photoluminescent material and light-reflective particles, notably glass beads or chips.

3. A device as claimed in claim 1, wherein the upper layer comprises a vinylic polymer having a plasticiser content of from 25 to 45 parts by weight per 100 parts by weight of resin and the composite sheet has a Shore A hardness of from 80 to 95.

4. A device as claimed in claim 1, wherein the leading or trailing edge of the device carries a dependent skirt or an upstanding edge adapted to cooperate with the riser adjacent the tread of the step on which the device is mounted.

5. A device for use on a tread portion of a step, said device consisting of an elongated member which defines an upper surface and includes at least one elongated recess, and a light-emitting element fixedly positioned in each elongated recess, said member being mountable on a tread portion of a step so that each light-emitting element extends in a length dimension of the tread portion, each light-emitting element comprising a base layer having a reflective upper surface, an intermediate layer incorporating a photoluminescent material, and an upper translucent, wear-resistant layer, said upper layer having a wear-resistant, exposed upper face which is located above said upper surface of said member.

* * * * *